United States Patent [19]

Hurley

[11] Patent Number: 5,072,942

[45] Date of Patent: Dec. 17, 1991

[54] GOLF SWING TRAINING DEVICE

[75] Inventor: Dale P. Hurley, Galveston, Tex.

[73] Assignee: Swing Right Manufacturing Inc., Alvin, Tex.

[21] Appl. No.: 586,412

[22] Filed: Sep. 21, 1990

[51] Int. Cl.[5] ..... A63B 69/36

[52] U.S. Cl. ..... 273/191 A

[58] Field of Search ..... 273/191 R, 191 A, 191 B, 273/192, 186 R, 186 C, 186 A, 193 R, 193 A, 193 B, 194 R

[56] References Cited

U.S. PATENT DOCUMENTS 1,567,530 12/1925 MacNaughton et al. ..... 273/191 A

*Primary Examiner*—George J. Marlo

*Attorney, Agent, or Firm*—Rosenblatt & Associates

[57] ABSTRACT

The invention is a golf swing training apparatus comprised of a frame supporting a rail on which is mounted a carriage which moves on the rail. The carriage has a mechanism to engage the golf club so that the golfer can stand within the frame and execute a complete swing while the club moves with the carriage to guide the swing throughout its execution. The track includes a channel having radially inner and outer opposed portions each curved inwardly to the other and separated by an intermediate flat portion. The carriage mounts at least three longitudinally spaced wheels, each on an axial mount adapted for normal disposition to the flat portion, one wheel being radially spaced from at least two other wheels, and the wheels are positioned to roll longitudinally within the curved portions of the channel. The wheels secure the carriage in the channel for guided movement along the circular track.

6 Claims, 2 Drawing Sheets

GOLF SWING TRAINING DEVICE

FIELD OF THE INVENTION

The field of the invention relates to devices which help improve a golfer's swing.

BACKGROUND OF THE INVENTION

In the past, a wide variety of golf swing training devices have been developed. U.S. Pat. No. 4,280,701 illustrates one such device, featuring an open ring mounted to a base which is movable during the golfer's stroke. Such devices are heavy and mechanically complicated, detracting from their utility in that portability of the device is not a feature which is designed in such a device. Similar devices which are mechanically complex in adjustment and construction are shown in U.S. Pat. Nos. 3,795,399; 3,711,103; and 3,489,416. Some of these devices don't use actual clubs at all, such as U.S. Pat. No. 3,794,329. Others require specially modified clubs, such as U.S. Pat. No. 4,583,740. U.S. Pat. No. 3,415,523 employs complex linkages hooked not only to the golfer's club but to a helmet to be worn on the head. Some provide a crescent-shaped guide to hold a carriage to which the club is guided by what amounts to an oarlock or an open-topped U-shaped bracket to assist the golfer in following the track. This type of open-grip design for the club facilitates the club coming out of contact with the carriage and guide assembly. Other devices comprised a freestanding pedestal hooked up to the club connected to a complicated assortment of linkages and such devices is U.S. Pat. No. 3,604,712. counterweights to facilitate control of the golfer's swing. Typical of such devices is U.S. Pat. No. 3,604,712.

Yet another style of these golf swing practice devices are those that have a rod-directed feature. Typical of these are U.S. Pat. Nos. 4,449,708; 4,211,418; 4,580,786; 4,486,020; and 4,653,757. Other types of devices employ a rail but no attachment between the rail and the club. The rail simply serves as a rest for the club throughout the swing. Typical of these devices are U.S. Pat. No. 3,583,707; 3,730,531; and 3,744,799. U.S. Pat. No. 4,071,251 provides a set of parallel tubes between which the golf club can be swung, wherein the parallel tubes act as a guide. U.S. Pat. No. 4,815,743 illustrates a device connected to the golfer s neck and shoulders rather than the club.

Yet other devices employ cords to guide the swing, such as illustrated in U.S. Pat. Nos. 4,034,991 and 3,917,281.

The following patents also relate to golf swing training devices and work on various principles illustrated in the other patents referred to above: U.S. Pat. No. 3,703,294 is a cord-guided device; U.S. Pat. No. 4,023,811 is a series of parallel tracks, useful to delineate the preferred trajectory for a swing; U.S. Pat. No. 4,678,193 is a freestanding frame supporting a curved rod used to train the golfer's swing; U.S. Pat. No. 3,341,208 is a ring on which the club can rest as a guide to the golfer in swinging; and U.S. Pat. No. 4,699,384 is a training device comprising a base which has two rods disposed at an angle to each other, with one rod forming an arc segment and the other being straight. A guide includes an obliquely upwardly extending barrier rail mounted on the arcuate rod which delineates the path of the upstroke of the golf swing. U.S. Pat. No. 3,246,898 is a swing trainer which does not employ clubs, wherein a rectangular plate is driven through a slot as a means of guiding the swing.

SUMMARY OF THE INVENTION

The invention is a golf swing training apparatus comprised of a frame supporting a rail on which is mounted a carriage which moves on the rail. The carriage has a mechanism to engage the golf club so that the golfer can stand within the frame and execute a complete swing while the club moves with the carriage to guide the swing throughout its execution.

DETAILED DESCRIPTION OF THE PREFERRED EMBODIMENT

Figure 1:
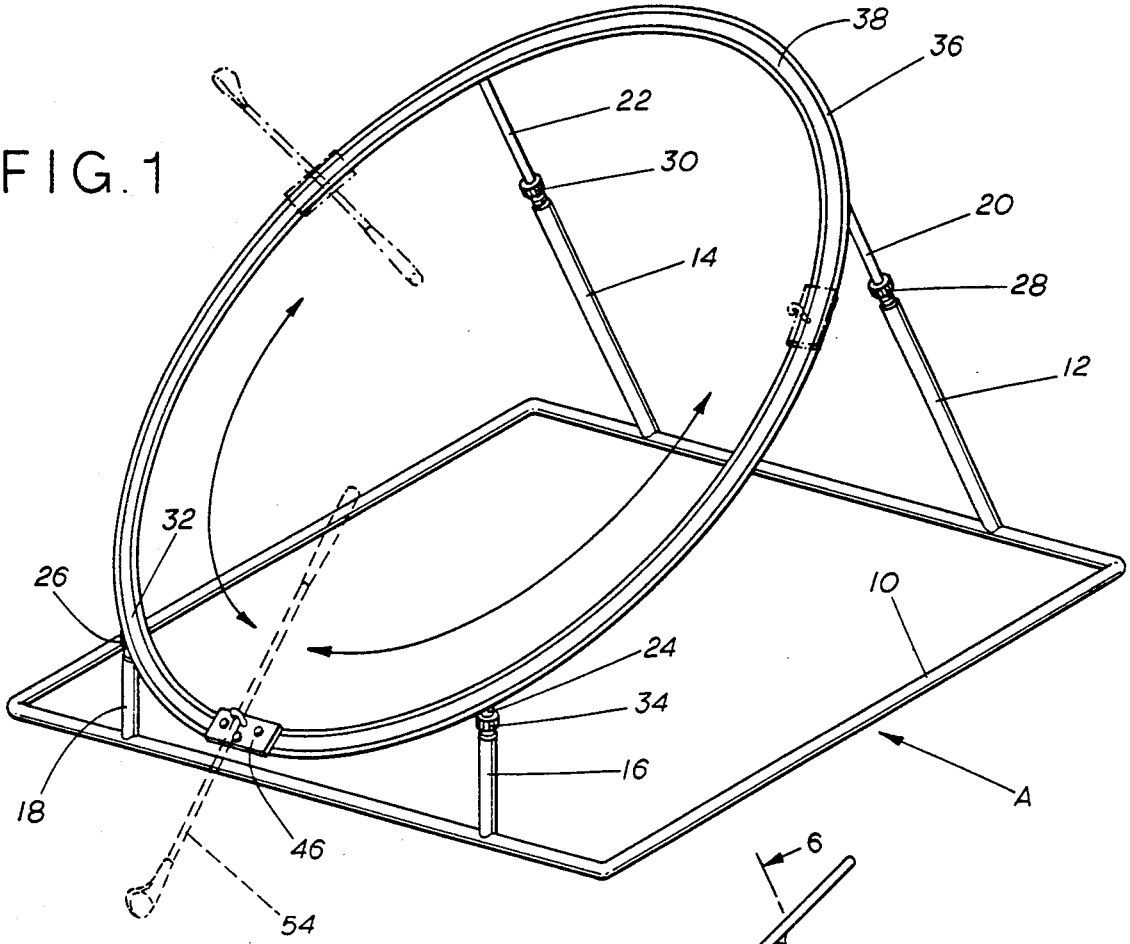
FIG. 1 is a perspective view of the apparatus of the present invention.
Figure 2:
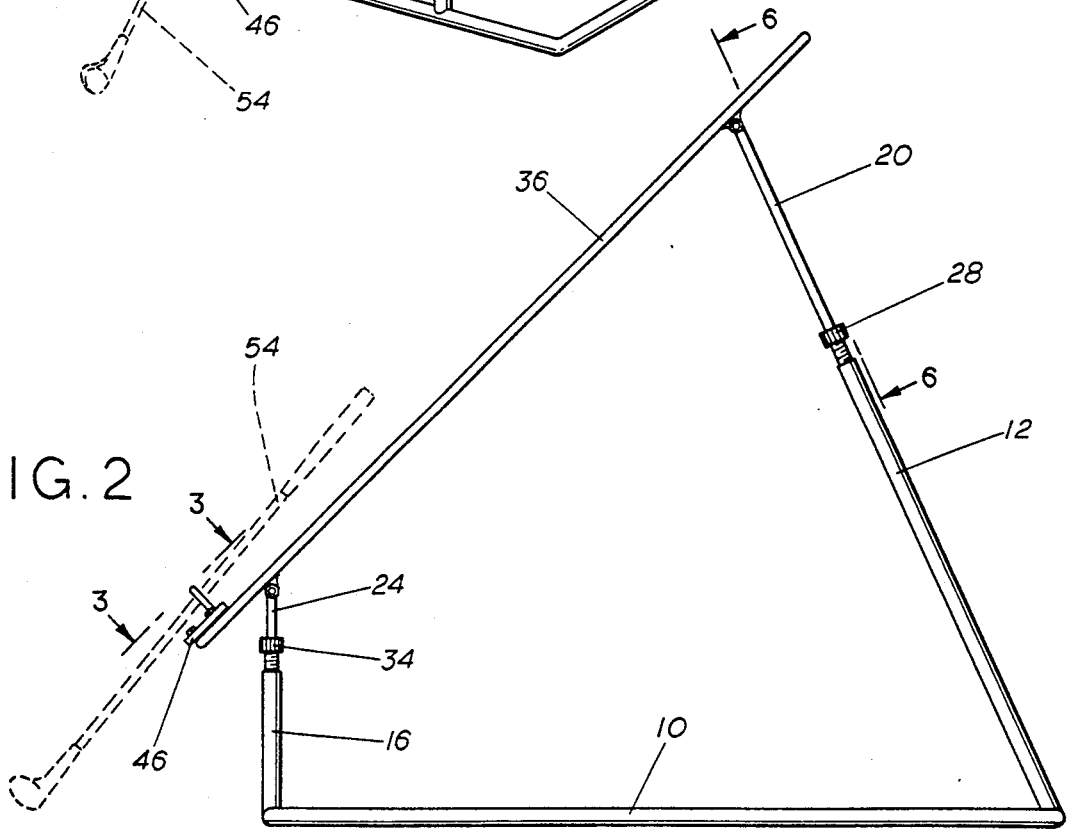
FIG. 2 is an end view of the same apparatus.
Figure 4:
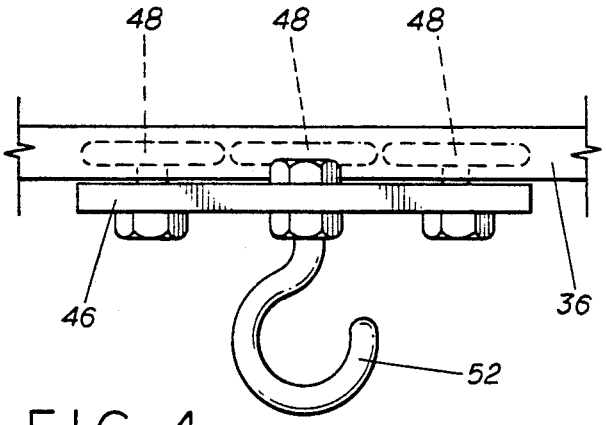
FIG. 4 is the view along line 4—4 of FIG. 3.
Figure 3:
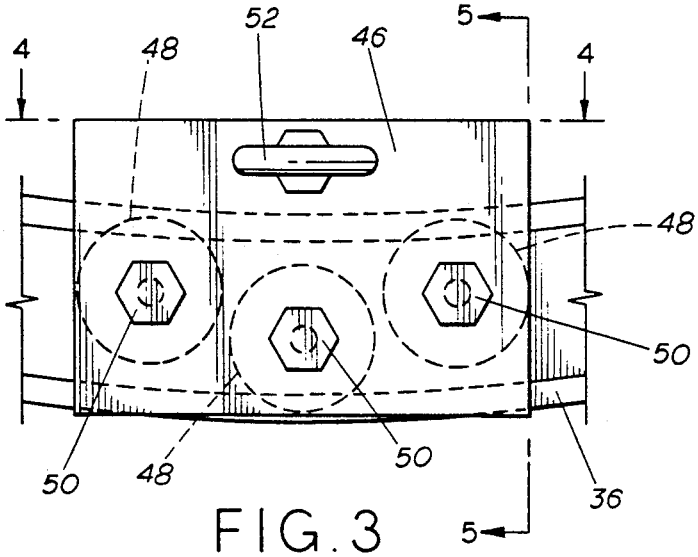
FIG. 3 is the view along lines 3—3 of FIG. 2.
Figure 5:
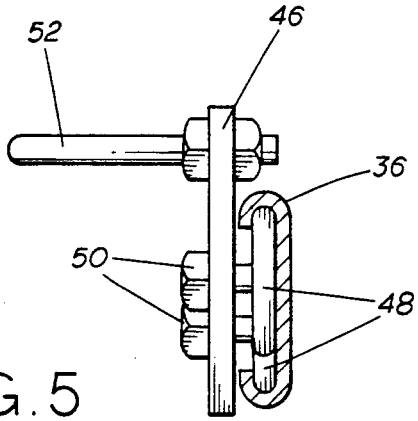
FIG. 5 is the view along line 5—5 of FIG. 3.
Figure 6:
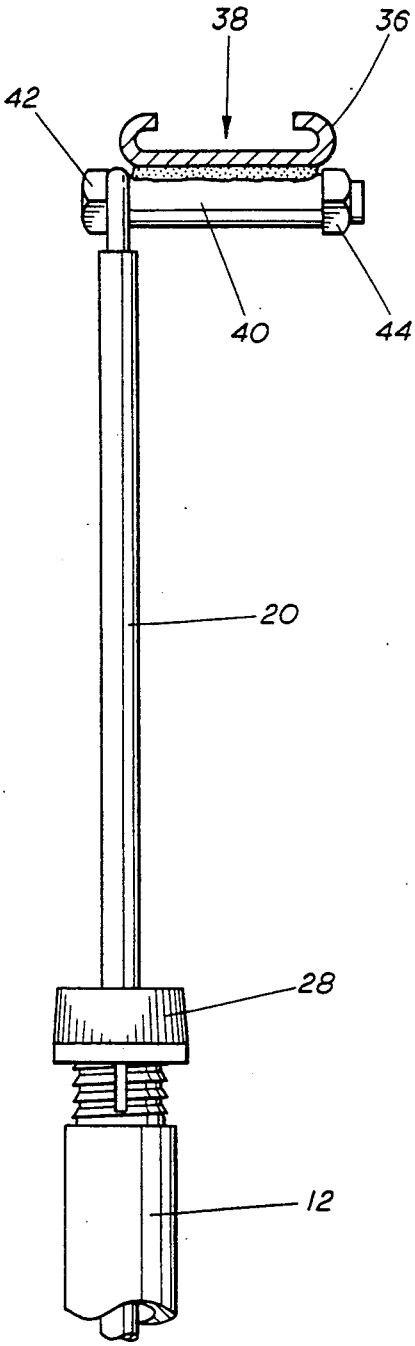
FIG. 6 is the view along line 6—6 of FIG. 2.

The apparatus A is shown in FIG. 1. The apparatus A has a base 10, which is preferably made of lightweight metallic tubular components. Extending from base 10 are two rear legs 12 and 14 and two front legs 16 and 18. Legs 12–18 are preferably made from a similar material as base 10. As seen in FIG. 2, rear legs 12 and 14 are inclined from the vertical, while front legs 16 and 18 are closer to vertical with respect to base 10. All the legs 12–18 have a telescoping feature for adjustment. Legs 12 and 14 are pivotally mounted to base 10. As illustrated in FIG. 1, legs, 12, 14, 16, and 18 have, respectively, upper sections 20, 22, 24, and 26. The overall length of rear leg 12 can be adjusted by loosening connector 28, which in FIG. 1 is illustrated to be a nut which prevents upper section 20 from telescoping into rear leg 12. Although a nut is shown to selectively fix the position of upper section 20 with respect to rear leg 12, different means of securing and unsecuring upper section 20 from rear leg 12 can be employed without departing from the spirit of the invention. The other legs have similar operation by use of connectors 30, 32, and 34. FIG. 6 shows in detail rear leg 12, connector 28, and upper section 20. Also shown in FIG. 6 in cross-section is track 36, which in the preferred embodiment is formulated from flat stock having ends curled up to form a channel 38. The channel 38 is welded to a pivot 40. Bolt 42 and nut 44 retain the track 36 to upper section 20. This connection is typical at each of the legs on the apparatus A. As seen in FIGS. 1 and 2, the telescoping nature of legs 12, 14, 16, and 18 allows the track 36 to be placed at different angles. A carriage 46, shown in FIG. 3, is secured to track 36. Carriage 46 has secured to it a plurality of wheels 48 which ride in notch or channel 38, as shown in FIG. 5. As shown in FIG. 3, two of the wheels are oriented toward one side of channel 38, while one placed in between is closer to the opposite side of channel 38. The channel 38 may have an opening to allow insertion or removal of carriage 46. The arrangement of wheels 48 is illustrated in FIG. 4. Each of the wheels 48 is secured by a nut 50. In the manner connected in FIGS. 3–5, the carriage 46 follows the path of channel 38. It should be noted that carriage 46 can be attached to track 36 in other ways without departing from the spirit of the invention. In fact, carriage 46 can be attached to track 36 in a manner that lets carriage 46 rotate on its own axis, as opposed to being bound to a channel 38. In this type of construction, track 36 might be configured as a tubular element having a rounded cross-section, and carriage 46 might have suitable clamping devices to permit some degree of rotation about its longitudinal axis with respect to the track 36. The bracket would have to be of the design which would allow it to clear the legs 12–18 which support track 36.

Also shown in FIGS. 3–5 is retention means 52, which in the embodiment shown in FIG. 4 is a hook. Other types of retention means 52 can be employed without departing from the spirit of the invention. Retention means 52 is rotatably mounted to carriage 46 for a full 360 degrees of movement. Retention means 52 is preferably made of a hard, smooth material which will not bind the golfer's stroke. The purpose of the retention means is to retain a golf club 54 to the carriage 46. The retention means allows the club to move in and out with respect to the carriage while the golfer strokes the club 54 and the carriage 46, which is constrained by track 36, guides the swing.

It can be seen that the apparatus A can be constructed to give guidance to a golfer in perfecting a swing, with a minimal amount of constraint on the swing. To that end, the carriage 46 can be given as many degrees of freedom as possible while still making it follow a track 36, which acts as the guide to the golfer in retaining his club in a common plane throughout the swing. The retention means 52 continually guides the club 54 throughout the stroke but does not crimp or bind the stroke. The apparatus A can be adjusted to accommodate golfers of different heights. The apparatus A can be adjusted to accommodate a flat or an upright swing.

The foregoing disclosure and description of the invention are illustrative and explanatory thereof, and various changes in the size, shape and materials, as well as in the details of the illustrated construction, may be made without departing from the spirit of the invention.

What is claimed is:

1. A training apparatus to improve the stroke of a golf club, comprising a continuous, circular shaped track comprising a channel having radially inner and outer opposed portions each curved inwardly to the other and separated by an intermediate flat portion, a base mounting said track, a carriage movable along said track and mounting at least three longitudinally spaced wheels, each on an axial mount adapted for normal disposition to said flat portion, one wheel being radially spaced from at least two other wheels, said wheels being positioned to roll longitudinally within said curved portions of said channel, said radial wheel spacing positioning at least one wheel to roll along said outer inwardly curved portion and positioning at least one other wheel to roll along said inwardly curved portion, said mounting wheels securing said carriage in said channel for guided movement along said circular track, and retention means on said carriage to retain said club on said carriage in a manner allowing radial movement relative to said track between said club and said carriage.

2. The trailing apparatus of claim 1 wherein said base includes four legs, each pivotally mounted on said track.

3. The trailing apparatus of claim 2 in which said four legs each have means for adjusting the height of the leg.

4. The apparatus of claim 1, wherein said retention means is a hook which is pivotally mounted to said carriage.

5. The apparatus of claim 1, wherein said retention means is an eyebolt which is pivotally mounted to said carriage.

6. The apparatus of claim 1, wherein said track is adapted to allow release of said carriage to prevent unauthorized use of the apparatus.

* * * * *